US011286539B2

(12) United States Patent
Nagai et al.

(10) Patent No.: US 11,286,539 B2
(45) Date of Patent: Mar. 29, 2022

(54) COOLING APPARATUS FOR METAL STRIP AND CONTINUOUS HEAT TREATMENT FACILITY FOR METAL STRIP

(71) Applicant: PRIMETALS TECHNOLOGIES JAPAN, LTD., Hiroshima (JP)

(72) Inventors: Takanori Nagai, Hiroshima (JP); Masashi Yoshikawa, Tokyo (JP); Ryusuke Kimoto, Tokyo (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 14 days.

(21) Appl. No.: 16/644,327

(22) PCT Filed: Nov. 20, 2017

(86) PCT No.: PCT/JP2017/041628
§ 371 (c)(1),
(2) Date: Mar. 4, 2020

(87) PCT Pub. No.: WO2019/097713
PCT Pub. Date: May 23, 2019

(65) Prior Publication Data
US 2020/0190622 A1 Jun. 18, 2020

(51) Int. Cl.
*C21D 9/573* (2006.01)

(52) U.S. Cl.
CPC ..... *C21D 9/5735* (2013.01)

(58) Field of Classification Search
CPC ..... C21D 9/573; C21D 9/5735; F27B 9/28
(Continued)

(56) References Cited

U.S. PATENT DOCUMENTS 3,897,906 A * 8/1975 Bachner ..... B22D 11/124 239/752
5,697,169 A * 12/1997 Jacob ..... B21B 45/0233 134/199
(Continued)

FOREIGN PATENT DOCUMENTS

CN 102597276 A 7/2012
CN 103056176 A 4/2013
(Continued)

OTHER PUBLICATIONS

International Search Report, issued in PCT/JP2017/041628, PCT/ISA/210, dated Feb. 20, 2018.
(Continued)

*Primary Examiner* — Scott R Kastler
*Assistant Examiner* — Michael Aboagye
(74) *Attorney, Agent, or Firm* — Birch, Stewart, Kolasch & Birch, LLP

(57) ABSTRACT

A cooling device for a metal plate includes a plurality of first nozzles and a plurality of second nozzles disposed on both sides of the metal plate, respectively, in a thickness direction of the metal plate across a pass line of the metal plate. The plurality of first nozzles form a staggered array in which a pitch in a width direction of the metal plate is Xn, a pitch in a longitudinal direction of the metal plate is Yn, and an offset amount in the width direction of a pair of first nozzles disposed adjacent to each other in the longitudinal direction is ΔXn. The plurality of second nozzles form a staggered array in which a pitch in the width direction is Xn, a pitch in the longitudinal direction is Yn, and an offset amount in the width direction of a pair of second nozzles disposed adjacent to each other in the longitudinal direction is ΔXn. The staggered array of the first nozzles and the staggered array of the second nozzles are disposed offset from each other such that, a center of the second nozzle is at a position
(Continued)

offset by a shift amount S from a center of the first nozzle in the width direction, and the center of the second nozzle is positioned in a region defined by an oval having a semi-axis of ΔXn/4 in the width direction and a semi-axis of Yn/3 in the longitudinal direction. The shift amount S is expressed by S=m×ΔXn/2, where m is an odd number such that S is closest to Xn/2.

7 Claims, 11 Drawing Sheets

(58) Field of Classification Search
USPC ..... 266/44, 46, 102, 111, 113, 251, 259; 148/661
See application file for complete search history.

(56) References Cited

U.S. PATENT DOCUMENTS 6,537,374 B2 * 3/2003 Matsuda ..... C21D 1/667 118/67
8,404,062 B2 * 3/2013 Ueoka ..... C21D 1/667 148/661
8,480,949 B2 * 7/2013 Kobayashi ..... F27B 9/28 266/111
8,500,927 B2 * 8/2013 Tachibana ..... B21B 37/76 148/511
8,881,568 B2 * 11/2014 Nakata ..... B21B 45/0233 72/201
2011/0018178 A1 1/2011 Muller et al.
2011/0266725 A1 * 11/2011 Mehrain ..... C21D 9/46 266/44
2012/0205842 A1 8/2012 Kobayashi et al.

FOREIGN PATENT DOCUMENTS

EP 2 100 673 A1 9/2008
EP 2 329 894 A1 6/2011
EP 2 495 343 A1 9/2012
JP 2011-94162 A 5/2011
JP 4977878 B2 7/2012
KR 10-2012-0069735 A 5/2012

OTHER PUBLICATIONS

Office Action dated Dec. 22, 2020 issued in counterpart European Application No. 17932170.8.
Extended European Search Report dated Jul. 10, 2020 issued to the corresponding EPC Application No. 17932170.8.
Office Action dated Jan. 13, 2021 issued in counterpart Chinese Application No. 201780092811.0 with an English Translation.
International Preliminary Report on Patentability and English translation of the Written Opinion of the International Searching Authority for International Application No. PCT/JP2017/041628, dated Jun. 4, 2020.
Office Action dated Sep. 22, 2021 issued in counterpart Korean Application No. 10-2020-7000038 with an English Machine Translation.

* cited by examiner

COOLING APPARATUS FOR METAL STRIP AND CONTINUOUS HEAT TREATMENT FACILITY FOR METAL STRIP

TECHNICAL FIELD

The present disclosure relates to a cooling apparatus for a metal strip and a continuous heat treatment facility for a metal strip.

BACKGROUND ART

It is known in a continuous heat treatment facility for a metal plate in a strip form that the metal strip is cooled by jet (gas jet) of a cooling gas.

For example, Patent Document 1 discloses a gas jet cooling apparatus for cooling a steel strip by jetting a cooling gas to the steel strip from a plurality of nozzles attached to pressure headers facing both surfaces of the steel strip. In this gas jet cooling apparatus, multiple nozzles are arranged in a staggered manner on each side of the steel strip to form nozzle groups. The nozzles forming the nozzle groups on both sides of the steel strip are arranged such that the nozzles of the nozzle group on one of the front and back sides of the steel strip are offset from the nozzles of the nozzle group on the other of the front and back side of the steel strip in the longitudinal direction and in the width direction of the steel strip.

CITATION LIST

Patent Literature

Patent Document 1: JP4977878B

SUMMARY

Problems to be Solved

In the gas jet cooling apparatus disclosed in Patent Document 1, as described above, the nozzle groups on the front and back sides of the steel strip are arranged to be offset in the longitudinal direction of the steel strip such that an offset amount is not less than ⅓ and not greater than ⅔ of the pitch of the nozzles in the longitudinal direction, and to be offset in the width direction of the steel strip such that an offset amount is not less than ⅙ and not greater than ⅓ of the pitch of the nozzles in the width direction to reduce vibration of the steel strip and reduce non-uniformity in the temperature distribution of the steel strip. However, it is desired to further equalize the temperature distribution of a metal strip after cooling.

In view of the above, an object of at least one embodiment of the present invention is to provide a cooling apparatus for a metal strip and a continuous heat treatment facility for a metal strip whereby it is possible to equalize the temperature distribution of the metal strip after cooling.

Solution to the Problems

A cooling apparatus according to at least one embodiment of the present invention comprises a plurality of first nozzles and a plurality of second nozzles disposed on both sides of a metal strip in a strip thickness direction, respectively, across a pass line of the metal strip. The plurality of first nozzles and the plurality of second nozzles each form a staggered array having a pitch of Xn in a strip width direction of the metal strip, a pitch of Yn in a longitudinal direction of the metal strip, and a displacement amount of ΔXn in the strip width direction between a pair of the first or second nozzles adjacent to each other in the longitudinal direction. The staggered array of the first nozzles and the staggered array of the second nozzles are offset from each other such that, a center of each second nozzle is positioned in a region defined by an ellipse having a center at a position offset by a shift amount S from a center of an adjacent first nozzle in the strip width direction and having a semi-axis of ΔXn/4 in the strip width direction and a semi-axis of Yn/3 in the longitudinal direction. The shift amount S is represented by $S=m\times\Delta Xn/2$, where m is an odd number such that S is closest to Xn/2.

Advantageous Effects

According to at least one embodiment, there is provided a cooling apparatus for a metal strip and a continuous heat treatment facility for a metal strip whereby it is possible to equalize the temperature distribution of the metal strip after cooling.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

First, with reference to FIG. 1, a continuous heat treatment facility for a metal strip to which a cooling apparatus 1 according to some embodiments is applied will be described.

Figure 1:
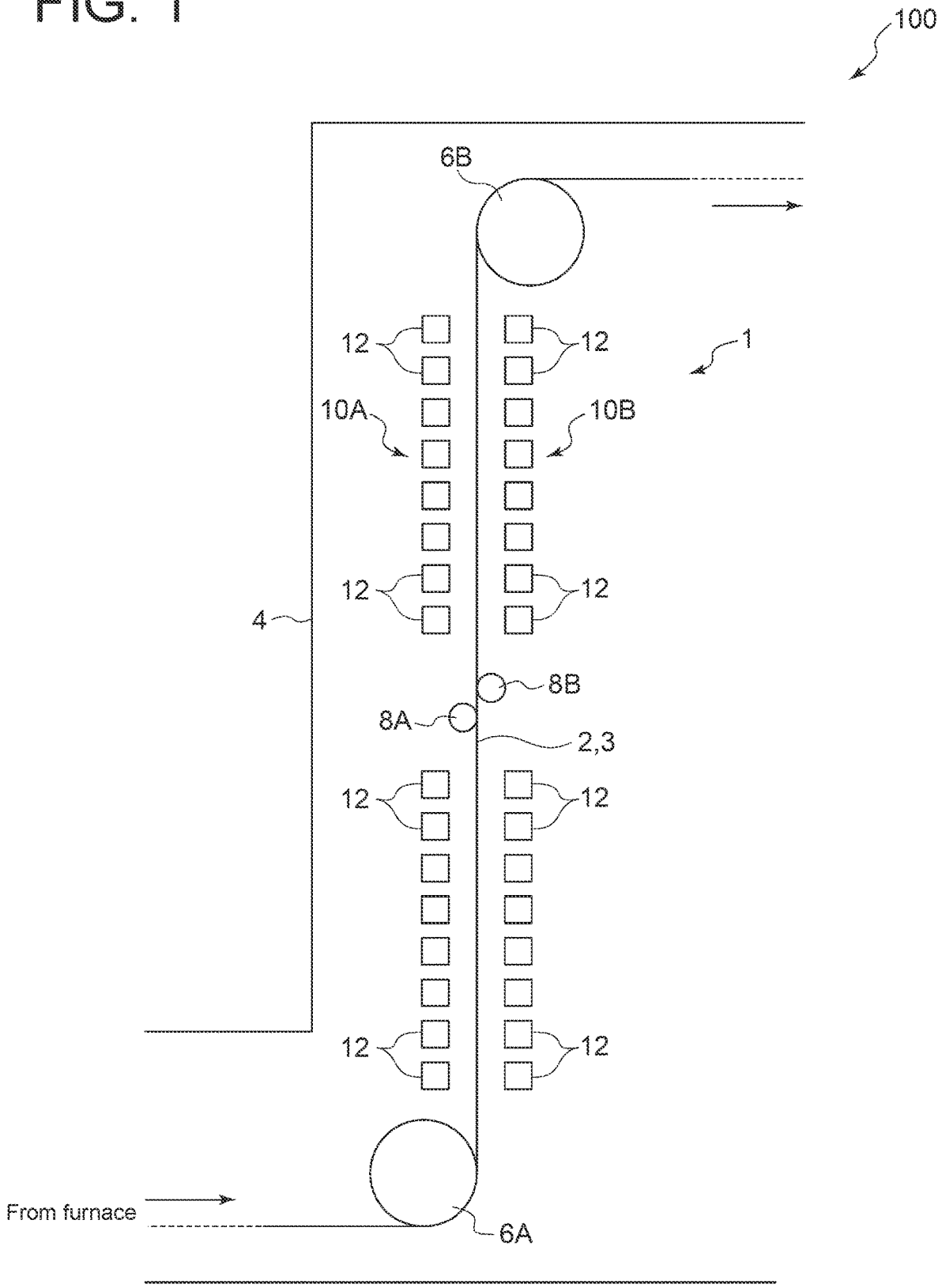
FIG. 1 is a schematic configuration diagram of a continuous heat treatment facility for a metal strip according to an embodiment.

FIG. 1 is a schematic configuration diagram of a continuous heat treatment facility for a metal strip according to an embodiment. As shown in FIG. 1, the continuous heat treatment facility 100 includes a furnace (not shown) for continuously performing heat treatment of a metal strip 2 (e.g., steel strip), rolls 6A, 6B for conveying the metal strip 2, and a cooling apparatus 1 for cooling the metal strip 2 heated by the furnace. The arrow in FIG. 1 represents the conveying direction (moving direction) of the metal strip 2.

As shown in FIG. 1, the roll 6A and roll 6B are disposed apart from each other in the vertical direction, and the metal strip 2 is conveyed between the roll 6A and roll 6B in the vertical direction (from bottom to top in the depicted example). Between the roll 6A and roll 6B, a pair of guide rolls 8A, 8B is disposed so as to sandwich the metal strip 2, which reduces bending and twisting of the metal strip 2.

The cooling apparatus 1 includes a pair of jet units 10A, 10B disposed on both sides in the strip thickness direction of the metal strip 2 (hereinafter, also simply referred to as "strip thickness direction"), respectively, across a pass line 3 of the metal strip 2. The pair of jet units 10A, 10B is configured to jet a cooling gas toward the metal strip 2.

By jetting the cooling gas (e.g., air) to both surfaces of the metal strip 2 from the pair of jet units 10A, 10B, it is possible to effectively cool the metal strip 2.

The continuous heat treatment facility 100 may be a continuous annealing furnace for continuously annealing the metal strip 2 by cooling the metal strip 2 with the cooling apparatus 1 after heating the metal strip 2 by the above-described furnace.

The cooling apparatus 1 according to some embodiments will now be described in more detail.

Figure 2:
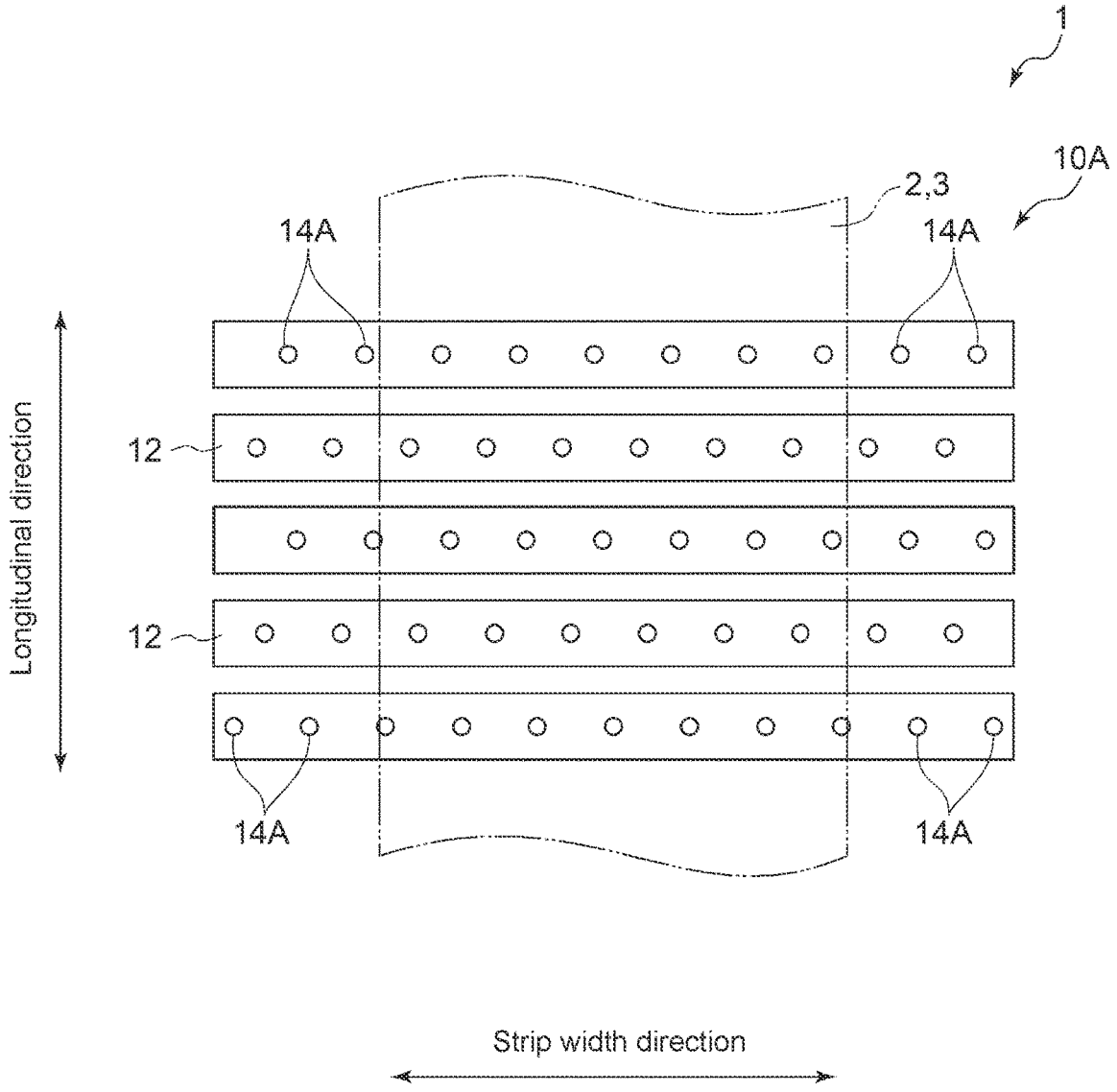
FIG. 2 is a schematic diagram of a cooling apparatus according to an embodiment viewed in the strip thickness direction of a metal strip.

FIG. 2 is a schematic diagram of the cooling apparatus 1 viewed in the strip thickness direction of the metal strip 2. More specifically, one of the pair of jet units 10A, 10*b*, namely the jet unit 10A, is viewed from the other, the jet unit 10B, in the strip thickness direction of the metal strip 2.

As shown in FIGS. 1 and 2, the jet units 10A, 10B of the cooling apparatus 1 are disposed along the strip width direction of the metal strip 2 (hereinafter, also simply referred to as "strip width direction") on both sides of the metal strip 2 in the strip thickness direction across the pass line 3 of the metal strip 2.

Each of the jet units 10A, 10B includes a header part 12 configured to be supplied with a high-pressure cooling gas, and a plurality of nozzles 14A, 14B disposed on the header part 12.

The plurality of nozzles 14A, 14B includes a plurality of first nozzles disposed on the jet unit 10A and a plurality of second nozzles disposed on the jet unit 10B. In other words, the plurality of first nozzles 14A and the plurality of second nozzles 14B are disposed on both sides of the metal strip 2 in the strip thickness direction, respectively, across the pass line 3 of the metal strip 2.

Each of the nozzles 14A, 14B communicates with the header part 12, and a high-pressure cooling gas supplied to the header part is jetted to one surface of the metal strip 2 through the nozzles 14A, while a high-pressure cooling gas supplied to the header part is jetted to the other surface of the metal strip 2 through the nozzles 14B.

In the cooling apparatus 1 shown in FIGS. 1 and 2, the header part 12 has a box-shape extending along the strip width direction, and multiple header parts 12 are arranged along the longitudinal direction of the metal strip 2 (conveying direction; also simply referred to as "longitudinal direction"). Further, as shown in FIG. 2, the nozzles 14A, 14B are arranged along the strip width direction on each of the header parts 12 arranged along the longitudinal direction (conveying direction).

Thus, the nozzles 14A, 14B arranged along the strip width direction on each of the header parts 12 arranged along the longitudinal direction form a staggered array, as described below.

In some embodiments, the staggered array of the plurality of nozzles 14A, 14B has the following feature.

Figure 3:
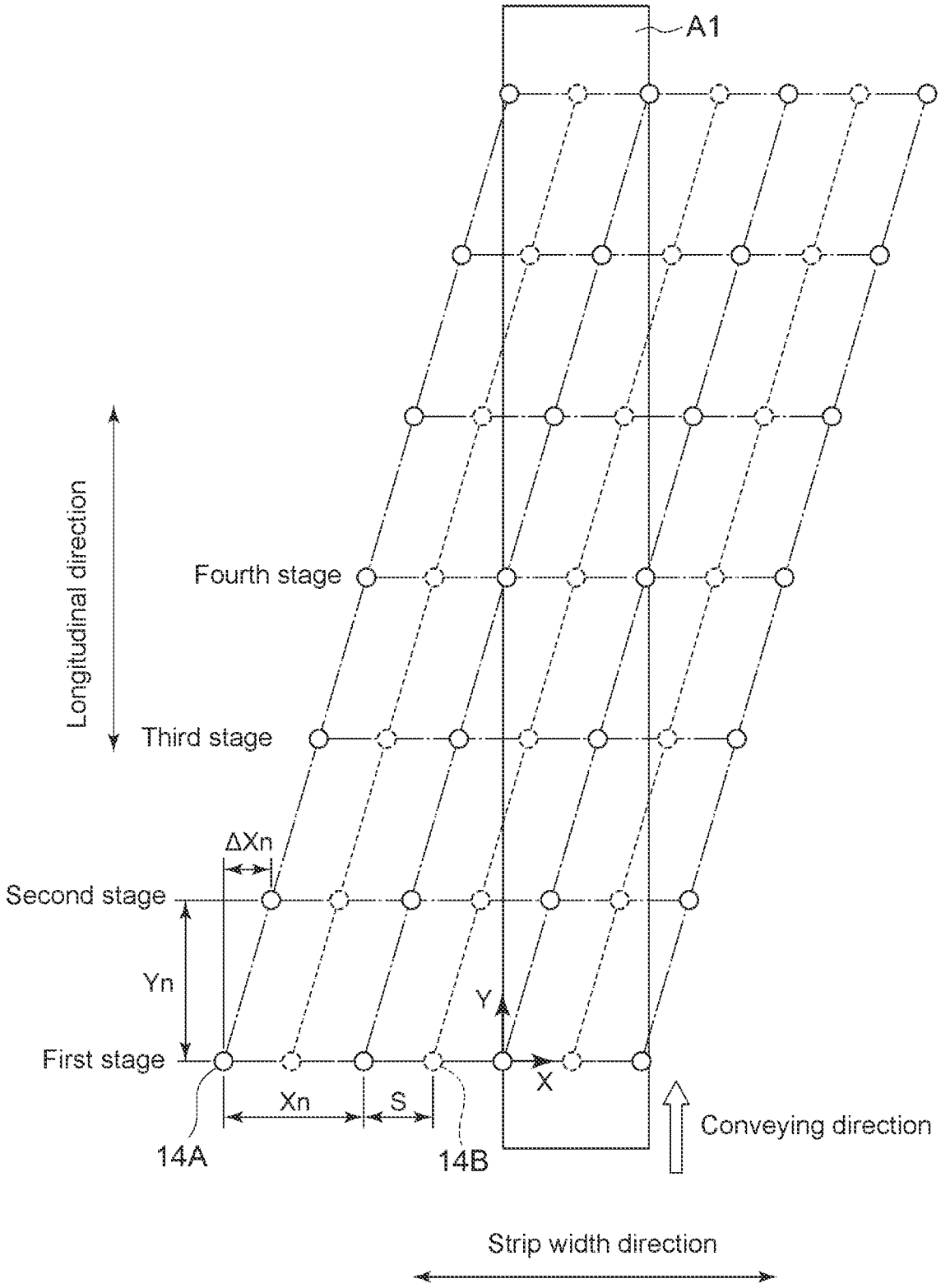
FIG. 3 is a schematic diagram of a part of staggered arrays formed by nozzles according to an embodiment.
Figure 4:
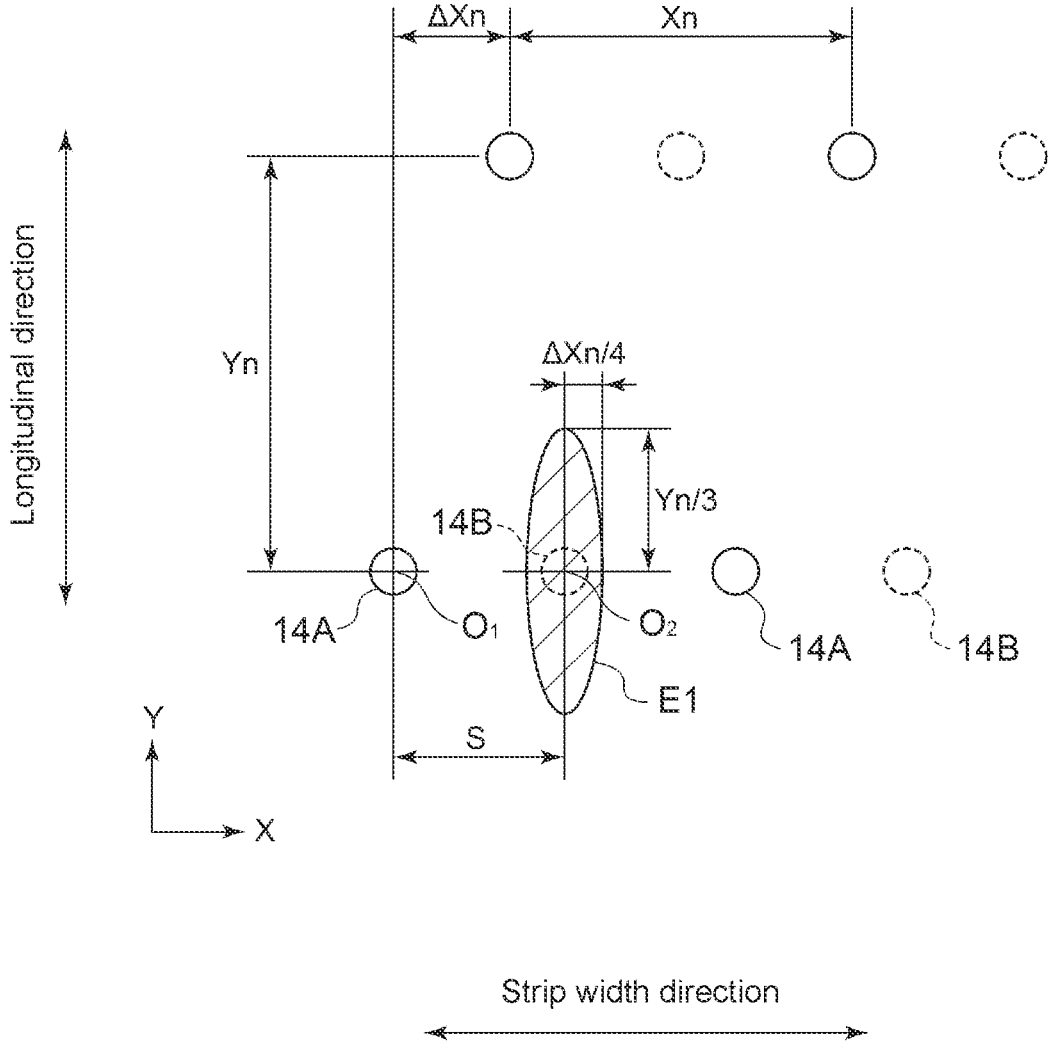
FIG. 4 is a partial enlarged view of the staggered arrays shown in FIG. 3.
Figure 5:
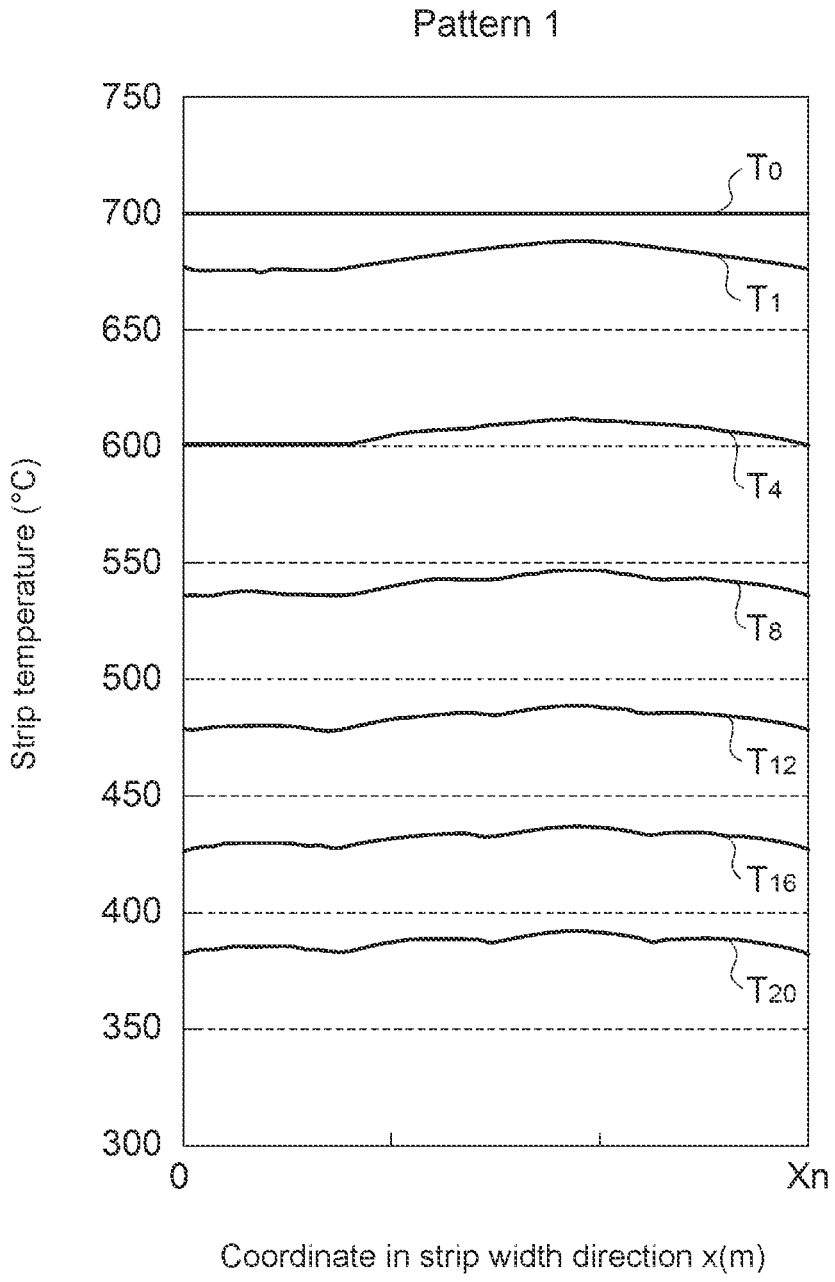
FIG. 5 is an example of calculation result of the temperature distribution during cooling of a steel strip.
Figure 6:
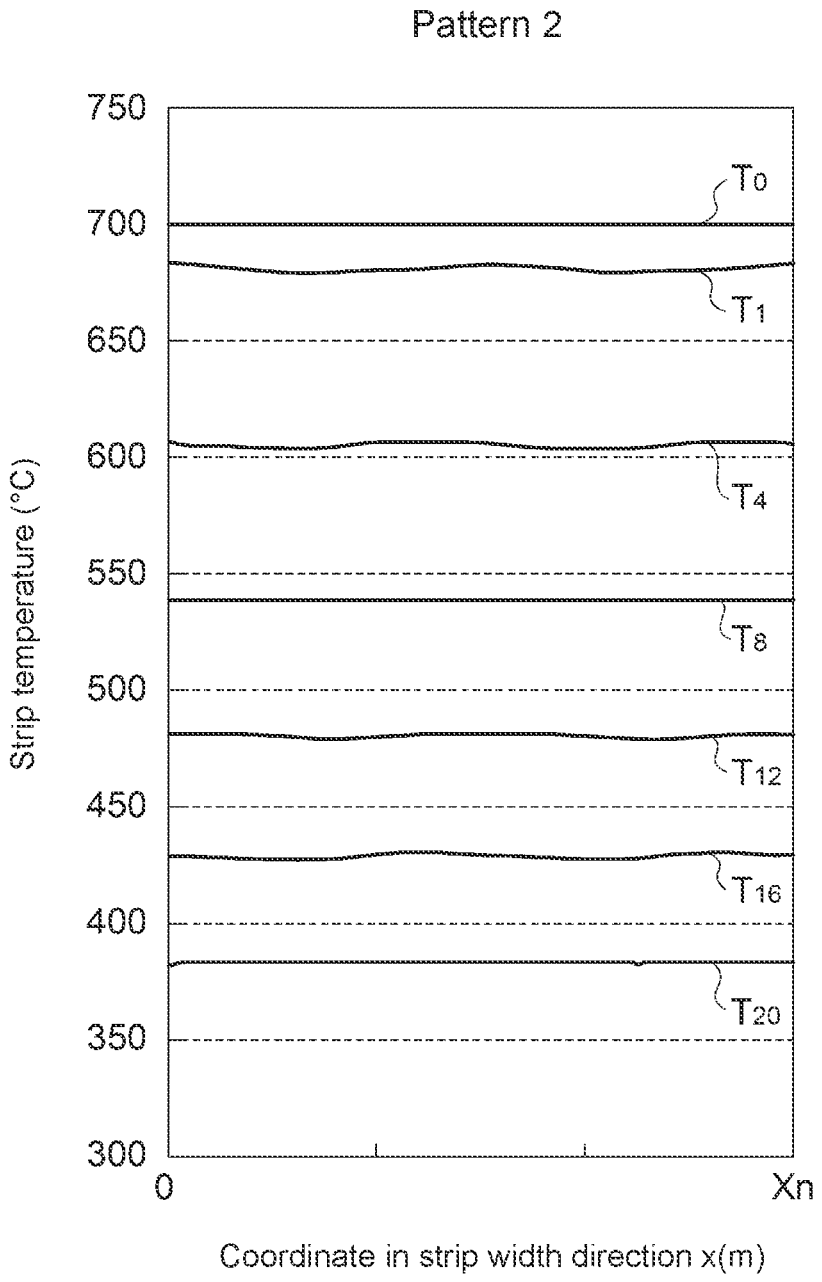
FIG. 6 is an example of calculation result of the temperature distribution during cooling of a steel strip.
Figure 7:
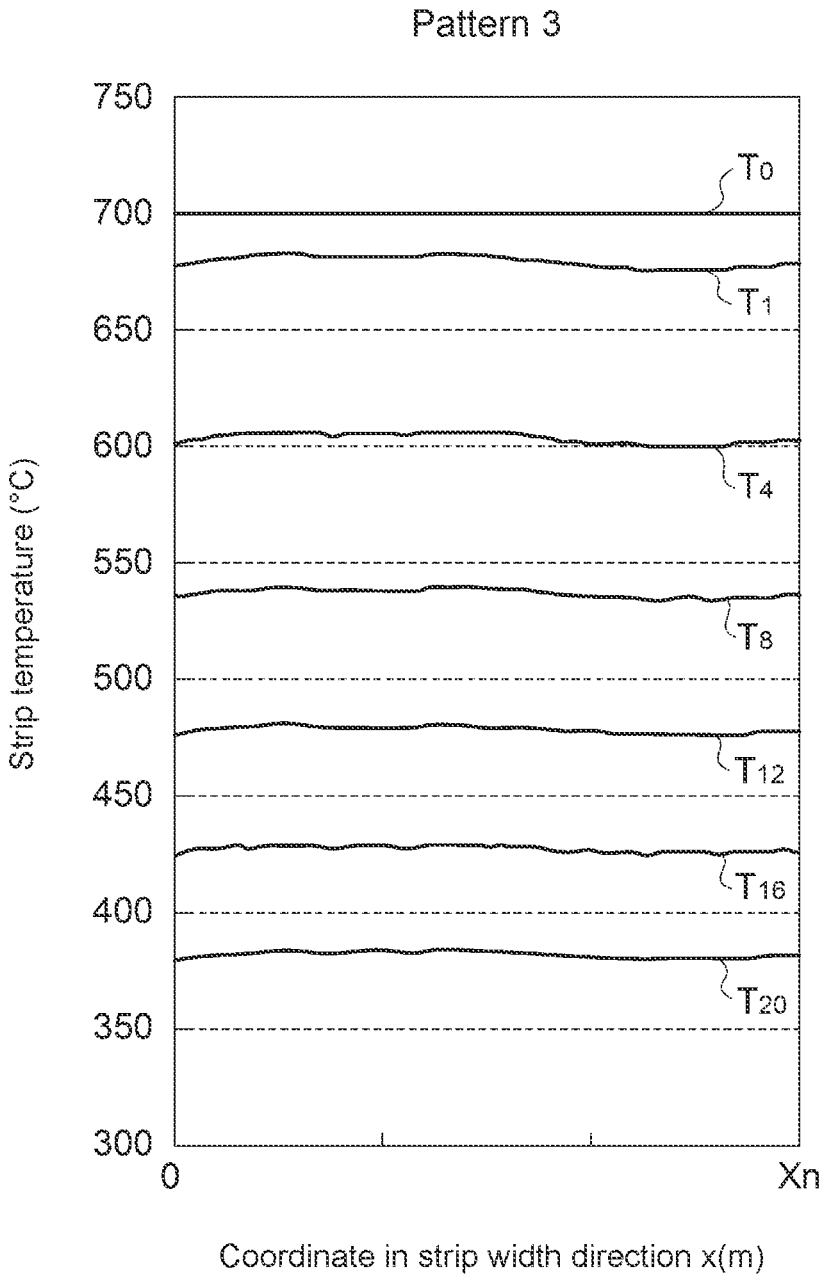
FIG. 7 is an example of calculation result of the temperature distribution during cooling of a steel strip.
Figure 8:
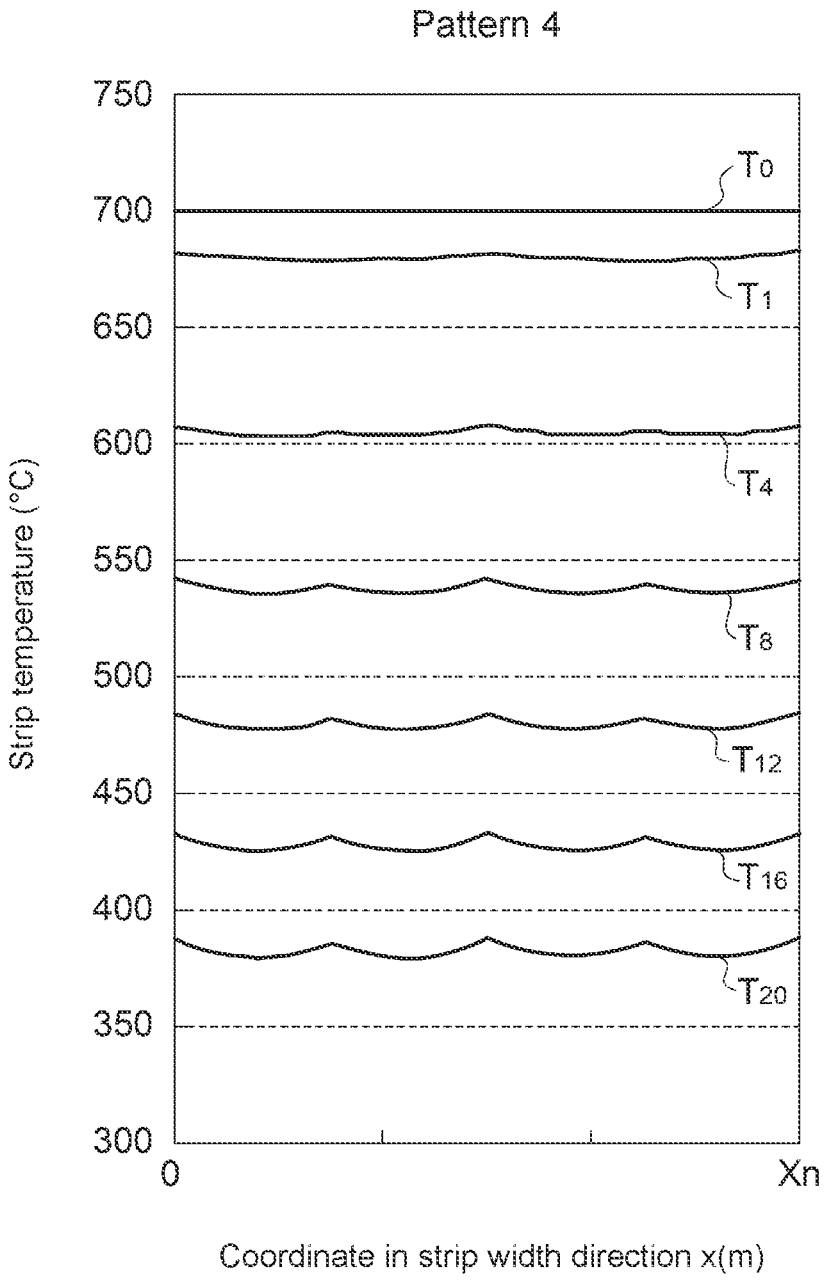
FIG. 8 is an example of calculation result of the temperature distribution during cooling of a steel strip.
Figure 9:
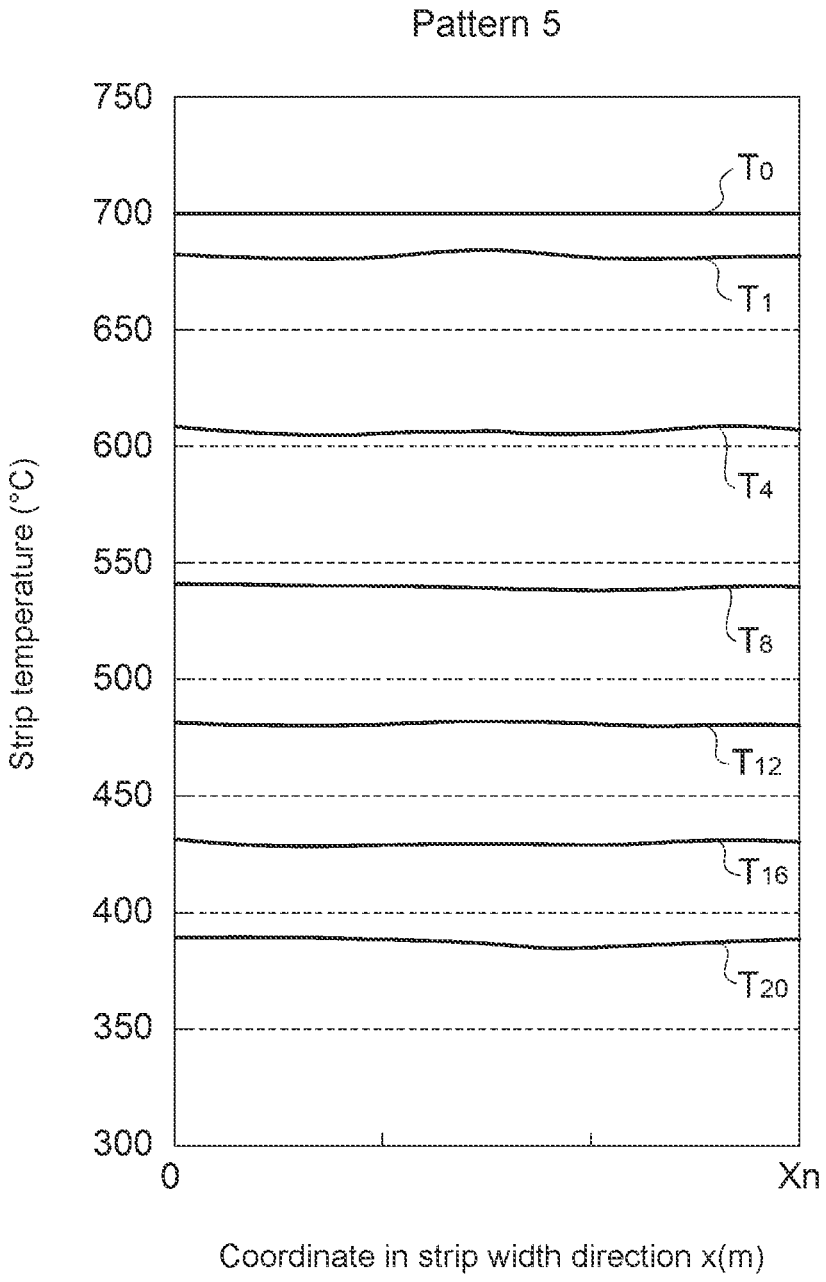
FIG. 9 is an example of calculation result of the temperature distribution during cooling of a steel strip.
Figure 10:
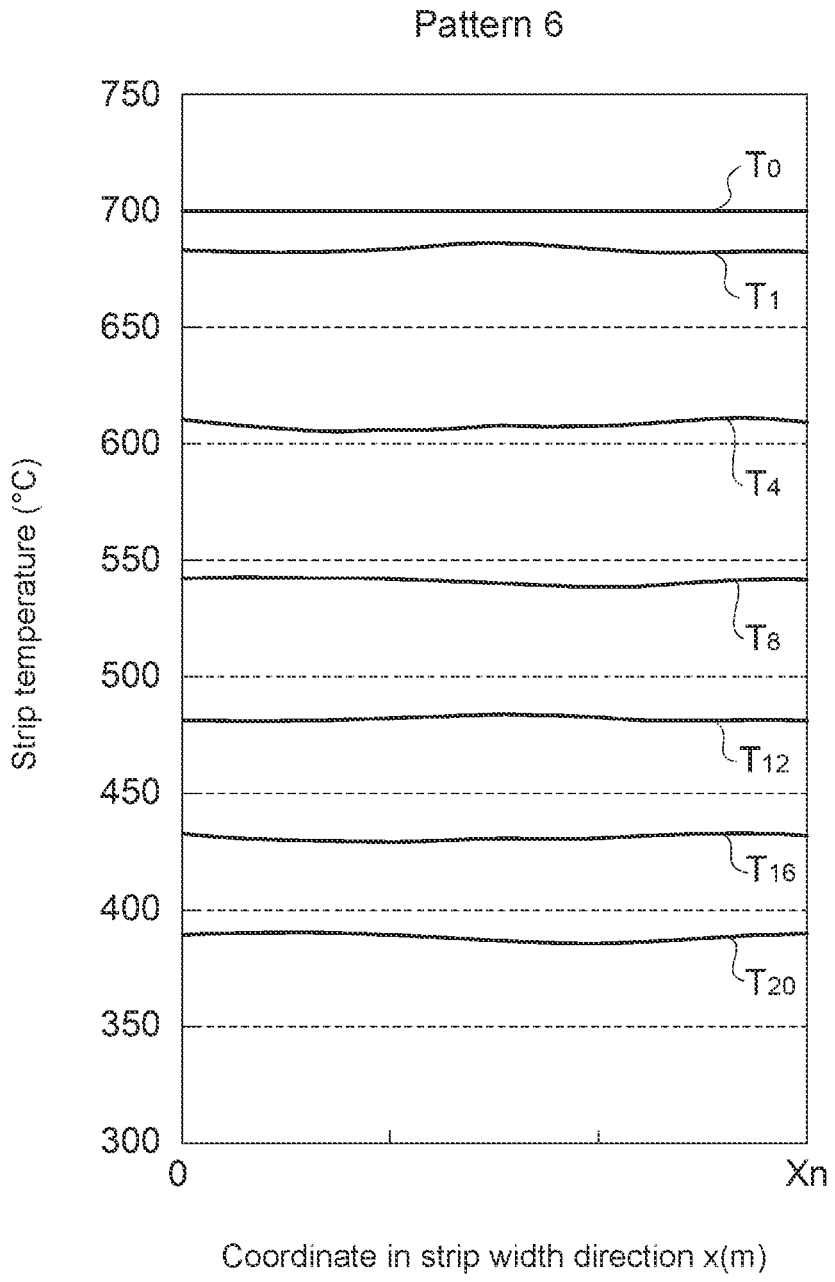
FIG. 10 is an example of calculation result of the temperature distribution during cooling of a steel strip.

FIGS. 3 and 4 are each a schematic diagram of a part of the staggered arrays formed by the nozzles 14A, 14B. FIG. 4 is a partial enlarged view of the staggered arrays shown in FIG. 3.

FIGS. 3 and 4 shows the arrangement of nozzles 14A, 14B when the pluralities of nozzles 14A, 14B are viewed in the identical strip thickness direction, and the staggered array formed by the plurality of nozzles 14A and the staggered array formed by the plurality of nozzles 14B are superimposed. In FIGS. 3 and 4, the nozzles 14A are represented by the solid line circle, while the nozzles 14B are represented by the dotted line circle.

In FIG. 3, not all the nozzles 14A, 14B included in the cooling apparatus 1 are shown, but a part of the nozzles 14A, 14B are shown within a range necessary for explaining the staggered arrays formed by the pluralities of nozzles 14A, 14B.

As shown in FIGS. 3 and 4, the plurality of first nozzles 14A forms a staggered array having a pitch of Xn in the strip width direction of the metal strip 2, a pitch of Yn in the longitudinal direction of the metal strip 2, and a displacement amount of ΔXn in the strip width direction between a pair of first nozzles 14A adjacent each other in the longitudinal direction.

The plurality of second nozzles 14B likewise forms a staggered array as with the plurality of first nozzles 14A. Specifically, the plurality of second nozzles 14B forms a staggered array having a pitch of Xn in the strip width direction of the metal strip 2, a pitch of Yn in the longitudinal direction of the metal strip 2, and a displacement amount of ΔXn in the strip width direction between a pair of second nozzles 14B adjacent each other in the longitudinal direction.

The staggered array of the first nozzles 14A and the staggered array of the second nozzles 14B are offset from each other in the strip width direction and/or in the longitudinal direction.

More specifically, as shown in FIG. 4, the staggered array of the first nozzles 14A and the staggered array of the second nozzles 14B are offset from each other such that, the center of the second nozzle 14B is positioned in a region (shown by the hatched area in FIG. 4) defined by an ellipse E1 having a center $O_2$ at a position offset by a shift amount S from the center $O_1$ of the first nozzle 14A in the strip width direction and having a semi-axis of ΔXn/4 in the width direction and a semi-axis of Yn/3 in the longitudinal direction.

The shift amount S is represented by $S=m\times\Delta Xn/2$, where m is an odd number such that S is closest to Xn/2.

Depending on the combination of the displacement amount ΔXn and the pitch Yn in the longitudinal direction of the staggered arrays of the first nozzles 14A and the second nozzles 14B, ΔXn/4 may be equal to Yn/3. In this case, the ellipse E1 having the semi-axis ΔXn/4 in the width direction and the semi-axis Yn/3 in the longitudinal direction is a circle having a radius of ΔXn/4(=Yn/3).

The shift amount S is an index of offset in the strip width direction of the staggered arrays formed by the plurality of first nozzles 14A and the plurality of second nozzles 14B disposed on both sides of the metal strip 2 in the strip thickness direction.

According to the above-described embodiment, since the shift amount S is closer to Xn/2, when viewed in a certain longitudinal position, a distance between nozzles including the first nozzles 14A and the second nozzles 14B aligned along the strip width direction is close to equidistance, and since the shift amount S is an odd multiple of ΔXn/2, strip-widthwise positions of the first nozzles 14A and the second nozzles 14B arranged in the longitudinal direction do not overlap. Thus, according to the above-described embodiment, it is possible to effectively equalize the temperature distribution of the metal strip 2 having passed through the first nozzles 14A and the second nozzles 14B.

In some embodiments, a ratio ΔXn/Xn of the displacement amount ΔXn to the pitch Xn in the strip width direction is not less than ¼ and not greater than ½.

In this case, since the displacement amount in the strip width direction between two longitudinally adjacent nozzles is appropriate without being too small, it is possible to effectively equalize the temperature distribution of the metal strip 2 having passed through the first nozzles 14A and the second nozzles 14B.

In some embodiments, a ratio ΔXn/Xn of the displacement amount ΔXn to the pitch Xn in the strip width direction is not less than ⅓ and not greater than ¼.

In this case, it is possible to effectively equalize the temperature distribution of the metal strip 2 having passed through the first nozzles 14A and the second nozzles 14B.

In some embodiments, the staggered array of each of the first nozzles 14A and the second nozzles 14B includes 10 or more nozzle rows each formed by a plurality of the first nozzles 14A or the second nozzles 14B aligned along the strip width direction.

In this case, the temperature distribution of the metal strip 2 having passed through the first nozzles 14A and the second nozzles 14B is easily equalized, compared to a case where the number of nozzle rows forming the staggered array is smaller.

Depending on the nozzle arrangement manner, as the number of nozzle rows increases, periodicity (non-uniformity) of the temperature distribution in the strip width direction may become prominent. However, according to the above-described embodiment, even when the number of nozzle rows is 10 or more, the temperature distribution of the metal strip 2 having passed through the first nozzles 14A and the second nozzles 14B is easily equalized.

In some embodiments, the shift amount S may be not less than Xn/3 and not greater than Xn×⅔.

Figure 11:
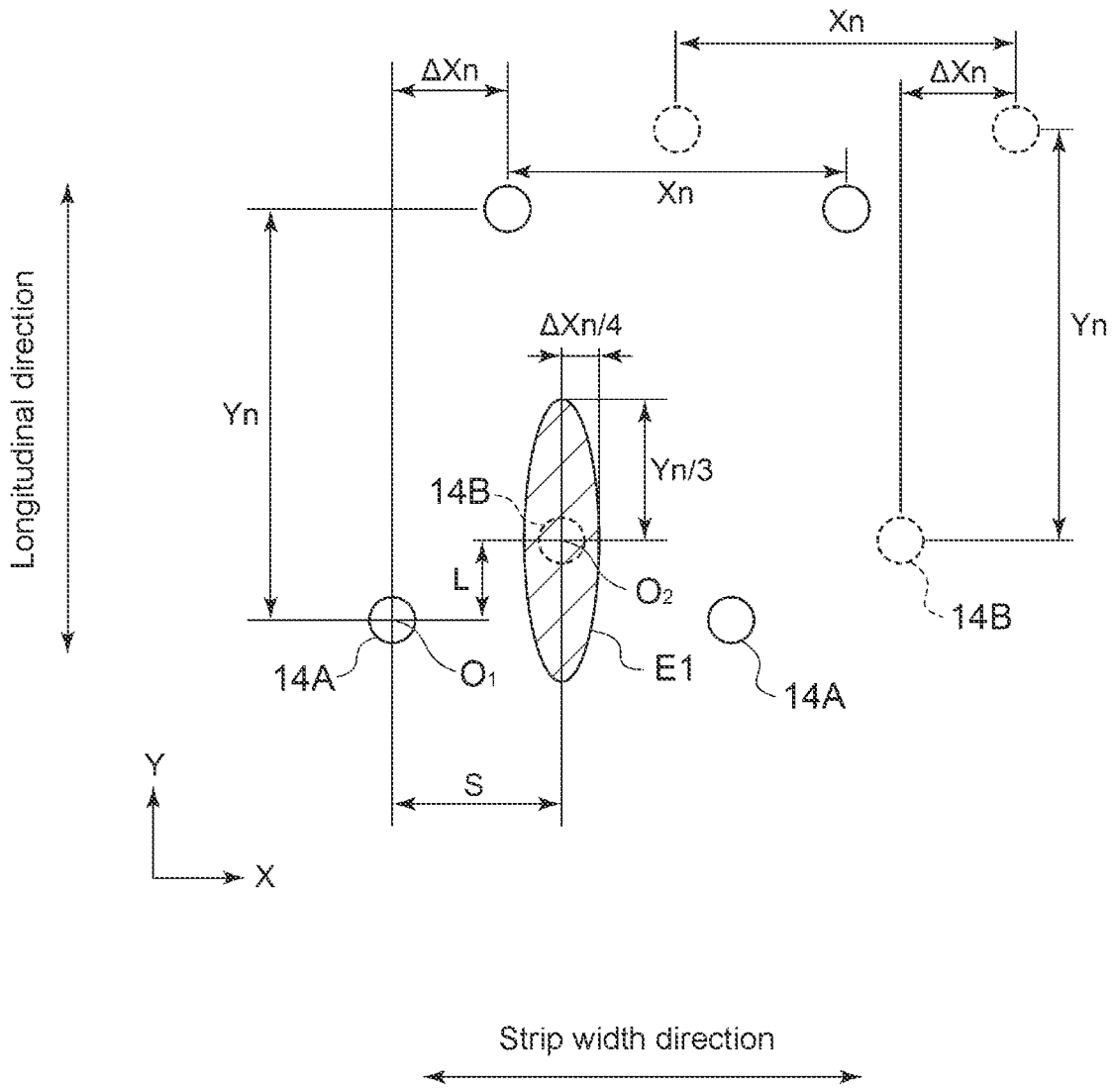
FIG. 11 is a schematic diagram of a part of staggered arrays formed by nozzles according to an embodiment.

FIG. 11 is a schematic diagram of a part of the staggered arrays formed by the nozzles 14A, 14B according to an embodiment, and is a partial enlarged view similar to FIG. 4.

In the exemplary embodiment shown in FIG. 11, the staggered array formed by the first nozzles 14A and the staggered array formed by the second nozzles are offset from each other by a distance L in the longitudinal direction. In other words, L is a distance in the longitudinal direction between the center $O_2$ of the second nozzle 14B and the center $O_1$ of the first nozzle 14A.

In some embodiments, a relationship of $0 \leq L/Yn \leq ⅓$ is satisfied where L is the distance in the longitudinal direction between the center $O_2$ of the second nozzle 14B and the center $O_1$ of the first nozzle 14A (see FIG. 11).

In this case, it is possible to effectively reduce non-uniform cooling of the metal strip 2 in the longitudinal direction, and it is possible to effectively equalize the temperature distribution of the metal strip 2 having passed through the first nozzles 14A and the second nozzles 14B.

In the embodiment shown in FIGS. 3 and 4, since the position of the center $O_2$ of the second nozzle 14B in the longitudinal direction coincides with that of the center $O_1$ of the first nozzle 14A, the distance L is zero. Accordingly, in FIGS. 3 and 4, the reference sign of the distance L is not shown.

The effect of equalizing the temperature distribution of the metal strip owing to the cooling apparatus 1 according to the above-described embodiments is shown by simulation results.

(Calculation Conditions)

The following conditions are used to calculate a temperature distribution in the strip width direction of a steel strip (metal strip) in each nozzle row position when the steel strip passes through the cooling apparatus 1 including the pluralities of first nozzles 14A and the second nozzles 14B forming staggered arrays in patterns 1 to 6 shown below.

Length of steel strip in strip width direction to be calculated: Xn (the same length as pitch Xn of staggered array in strip width direction; see analysis area A1 shown in FIG. 3)

Number of nozzle rows forming staggered array: 20 rows (20 stages)

Parameters indicating features of staggered array in each pattern (Xn, Yn, ΔXn, S, L): see the following table

TABLE 1

| | Δχn/χn | S/Xn | L/Yn |
|---|---|---|---|
| Pattern 1 | ½ | ¼ or ¾ | 0 |
| Pattern 2 | ⅓ | ½(=⅜) | 0 |
| Pattern 3 | ¼ | ⅜ or ⅝ | 0 |
| Pattern 4 | ¼ | ½ | 0 |
| Pattern 5 | ⅓ | ½(=⅜) | ⅓ |
| Pattern 6 | ⅓ | ½(=⅜) | ½ |

Calculation results of the temperature distributions in pattern 1 to 6 are shown in FIGS. 5 to 10, respectively. In each graph of FIGS. 5 to 10, the horizontal axis represents position in the strip width direction of the steel strip in the analysis area A1 (see FIG. 3), and the vertical axis represents temperature of the steel strip. Further, in each graph, $T_0$ means initial temperature (temperature before passing through nozzles), and Tn means temperature at the time of passing through the nozzles in an n-row (n-stage).

The patterns 1 to 3, 5, and 6 are examples of the present invention, while the pattern 4 is a comparative example where "m" is an even number.

Comparing the calculation results of the patterns 1 to 3 and the pattern 4, as the number of nozzle rows through which the steel strip passes increases, in the pattern 4, the temperature distribution in the strip width direction becomes non-uniform and periodically increases and decreases, while in the patterns 1 to 3 having the features of the present invention, the temperature distribution after cooling with the nozzles gradually becomes uniform.

The reason may be that, in the patterns 1 to 3, since the shift amount S is closer to Xn/2, and the shift amount S is an odd multiple of ΔXn/2, a distance between the nozzles including the first nozzles 14A and the second nozzles 14B aligned along the strip width direction is close to equidistance, and strip-widthwise positions of the first nozzles 14A and the second nozzles 14B arranged in the longitudinal direction do not overlap.

In particular, in the patterns 2 and 3, the temperature distribution of the steel strip after passing through the nozzle rows is remarkably uniform. This indicates that the temperature distribution equalization effect is high when the ratio ΔXn/Xn of the displacement amount ΔXn to the pitch Xn in the strip width direction is ⅓ or ¼.

In this case, it is possible to effectively equalize the temperature distribution of the metal strip 2 having passed through the first nozzles 14A and the second nozzles 14B.

Further, in the patterns 2, 5, and 6, although the shape of the staggered arrays of the first nozzles 14A and the second nozzles 14B are the same, the displacement amounts between the first nozzle 14A and the second nozzle 14B in the longitudinal direction are different.

According to the calculation results of the pattern 2, 5, and 6, the temperature distribution of the metal strip 2 after passing through the first nozzles 14A and the second nozzles 14B is relatively equalized in any pattern. Among them, a pattern with a smaller L/Yn exhibits a higher equalization effect. In particular, this effect is higher in the pattern 2 satisfying L/Yn=0 (i.e., the position of the center $O_2$ of the second nozzle 14B in the longitudinal direction coincides with that of the center $O_1$ of the first nozzle 14A).

In the following, the outline of the cooling apparatus and the continuous heat treatment facility according to some embodiments will be described.

(1) A cooling apparatus according to at least one embodiment of the present invention comprises a plurality of first nozzles and a plurality of second nozzles disposed on both sides of a metal strip in a strip thickness direction, respectively, across a pass line of the metal strip. The plurality of first nozzles forms a staggered array having a pitch of Xn in a strip width direction of the metal strip, a pitch of Yn in a longitudinal direction of the metal strip, and a displacement amount of ΔXn in the strip width direction between a pair of the first nozzles adjacent to each other in the longitudinal direction. The plurality of second nozzles forms a staggered array having a pitch of Xn in the strip width direction, a pitch of Yn in the longitudinal direction, and a displacement amount of ΔXn in the strip width direction between a pair of the second nozzles adjacent to each other in the longitudinal direction. The staggered array of the first nozzles and the staggered array of the second nozzles are offset from each other such that, a center of each second nozzle is positioned in a region defined by an ellipse having a center at a position offset by a shift amount S from a center of an adjacent first nozzle in the strip width direction and having a semi-axis of ΔXn/4 in the strip width direction and a semi-axis of Yn/3 in the longitudinal direction. The shift amount S is represented by S=m×ΔXn/2, where m is an odd number such that S is closest to Xn/2.

The shift amount S is an index of offset in the strip width direction of the staggered arrays formed by the plurality of first nozzles and the plurality of second nozzles disposed on both sides of the metal strip in the strip thickness direction.

With the above configuration (1), since the shift amount S is closer to Xn/2, when viewed in a certain longitudinal position, a distance between nozzles including the first nozzles and the second nozzles aligned along the strip width direction is close to equidistance, and since the shift amount S is an odd multiple of ΔXn/2, strip-widthwise positions of the first nozzles and the second nozzles arranged in the longitudinal direction are not likely to overlap. Thus, with the above configuration (1), it is possible to equalize the temperature distribution of the metal strip having passed through the first nozzles and the second nozzles.

(2) In some embodiments, in the above configuration (1), a ratio ΔXn/Xn of the displacement amount ΔXn to the pitch Xn in the strip width direction is not less than ¼ and not greater than ½.

With the above configuration (2), since ΔXn/Xn is not less than ¼ and not greater than ½, so that the displacement amount in the strip width direction between two longitudinally adjacent nozzles is appropriate without being too small, it is possible to effectively equalize the temperature distribution of the metal strip having passed through the first nozzles and the second nozzles.

(3) In some embodiments, in the above configuration (2), the ratio ΔXn/Xn is ⅓ or ¼.

With the above configuration (3), since ΔXn/Xn is ⅓ or ¼, it is possible to more effectively equalize the temperature distribution of the metal strip having passed through the first nozzles and the second nozzles.

(4) In some embodiments, in any one of the above configurations (1) to (3), the staggered array of the first nozzles includes 10 or more nozzle rows each formed by a plurality of the first nozzles aligned along the strip width direction, and the staggered array of the second nozzles includes 10 or more nozzle rows each formed by a plurality of the second nozzles aligned along the strip width direction.

With the above configuration (4), since the staggered arrays of the first nozzles and the second nozzles each include 10 or more nozzle rows, the temperature distribution of the metal strip 2 having passed through the first nozzles and the second nozzles is easily equalized, compared to a case where the number of nozzle rows forming the staggered array is smaller.

Depending on the nozzle arrangement manner, as the number of nozzle rows increases, periodicity (non-uniformity) of the temperature distribution in the strip width direction may become prominent. In this regard, with the above configuration (4), even when the number of nozzle rows is 10 or more, the temperature distribution of the metal strip having passed through the first nozzles and the second nozzles is easily equalized.

(5) In some embodiments, in any one of the above configurations (1) to (4), the shift amount S is not less than Xn/3 and not greater than Xn×⅔.

(6) In some embodiments, in any one of the above configurations (1) to (5), a relationship of 0≤L/Yn≤⅓ is satisfied, where L is a distance in the longitudinal direction between the center $O_2$ of the second nozzle 14B and the center $O_1$ of the first nozzle 14A.

With the above configuration (6), since the center of the second nozzle and the center of the first nozzle are at the same position in the longitudinal direction, it is possible to reduce non-uniform cooling of the metal strip in the longitudinal direction, and it is possible to effectively equalize the temperature distribution of the metal strip having passed through the first nozzles and the second nozzles.

(7) A continuous heat treatment facility according to at least one embodiment of the present invention comprises: a furnace for performing heat treatment of a metal strip; and the cooling apparatus described in any one of the above (1) to (6) configured to cool the metal strip which has subjected to the heat treatment in the furnace.

With the above configuration (7), since the shift amount S is closer to Xn/2, when viewed in a certain longitudinal position, a distance between nozzles including the first nozzles and the second nozzles aligned along the strip width direction is close to equidistance, and since the shift amount S is an odd multiple of ΔXn/2, strip-widthwise positions of the first nozzles and the second nozzles arranged in the longitudinal direction do not overlap. Thus, with the above configuration (7), it is possible to equalize the temperature distribution of the metal strip having passed through the first nozzles and the second nozzles.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Cooling apparatus
2 Metal strip
3 Pass line
6A Roll
6B Roll
8A Guide roll
8B Guide roll
10A Jet unit
10B Jet unit
12 Header part
14A First nozzle
14B Second nozzle
100 Continuous heat treatment facility
A1 Analysis area
$O_1$ Center of first nozzle
$O_2$ Center of second nozzle
S Shift amount
Xn Pitch in strip width direction
Yn Pitch in longitudinal direction
ΔXn Displacement amount

The invention claimed is:

1. A cooling apparatus for a metal strip, comprising a plurality of first nozzles and a plurality of second nozzles disposed on both sides of a metal strip in a strip thickness direction, respectively, across a pass line of the metal strip, wherein the plurality of first nozzles forms a staggered array having a pitch of Xn in a strip width direction of the metal strip, a pitch of Yn in a longitudinal direction of the metal strip, and a displacement amount of ΔXn in the strip width direction between a pair of the first nozzles adjacent to each other in the longitudinal direction, wherein the plurality of second nozzles forms a staggered array having a pitch of Xn in the strip width direction, a pitch of Yn in the longitudinal direction, and a displacement amount of ΔXn in the strip width direction between a pair of the second nozzles adjacent to each other in the longitudinal direction, wherein the staggered array of the first nozzles and the staggered array of the second nozzles are offset from each other such that, a center of each second nozzle is positioned in a region defined by an ellipse having a center at a position offset by a shift amount S from a center of an adjacent first nozzle in the strip width direction and having a semi-axis of ΔXn/4 in the strip width direction and a semi-axis of Yn/3 in the longitudinal direction, wherein the shift amount S is represented by $S=m\times\Delta Xn/2$, where m is an odd number such that S is closest to Xn/2, and wherein the ratio ΔXn/Xn is ⅓ or ¼.

2. The cooling apparatus according to claim 1, wherein the staggered array of the first nozzles includes 10 or more nozzle rows each formed by a plurality of the first nozzles aligned along the strip width direction, and wherein the staggered array of the second nozzles includes 10 or more nozzle rows each formed by a plurality of the second nozzles aligned along the strip width direction.

3. The cooling apparatus according to claim 1, wherein a relationship of $0\leq L/Yn\leq 1/3$ is satisfied, where L is a distance in the longitudinal direction between the center of the second nozzle and the center of the first nozzle.

4. A continuous heat treatment facility for a metal strip, comprising:

the cooling apparatus according to claim 1 configured to cool the metal strip which has been subjected to the heat treatment in a furnace.

5. The cooling apparatus according to claim 3, wherein the distance L is zero.

6. A cooling apparatus for a metal strip, comprising:

a plurality of first nozzles and a plurality of second nozzles disposed on both sides of a metal strip in a strip thickness direction, respectively, across a pass line of the metal strip, wherein the plurality of first nozzles forms a staggered array having a pitch of Xn in a strip width direction of the metal strip, a pitch of Yn in a longitudinal direction of the metal strip, and a displacement amount of ΔXn in the strip width direction between a pair of the first nozzles adjacent to each other in the longitudinal direction, wherein the plurality of second nozzles forms a staggered array having a pitch of Xn in the strip width direction, a pitch of Yn in the longitudinal direction, and a displacement amount of ΔXn in the strip width direction between a pair of the second nozzles adjacent to each other in the longitudinal direction, wherein the staggered array of the first nozzles and the staggered array of the second nozzles are offset from each other such that, a center of each second nozzle is positioned in a region defined by an ellipse having a center at a position offset by a shift amount S from a center of an adjacent first nozzle in the strip width direction and having a semi-axis of ΔXn/4 in the strip width direction and a semi-axis of Yn/3 in the longitudinal direction, wherein the shift amount S is represented by $S=m\times\Delta Xn/2$, where in is an odd number such that S is closest to Xn/2, and wherein the shift amount S is not less than Xn×⅜ and not greater than Xn×⅝.

7. A continuous heat treatment facility for a metal strip, comprising:

the cooling apparatus according to claim 6 configured to cool the metal strip which has been subjected to the heat treatment in a furnace.

* * * * *